US008129677B2

(12) United States Patent
Truche et al.

(10) Patent No.: US 8,129,677 B2
(45) Date of Patent: Mar. 6, 2012

(54) METHOD AND APPARATUS FOR SURFACE DESORPTION IONIZATION BY CHARGED PARTICLES

(75) Inventors: Jean-Luc Truche, Los Altos, CA (US); Paul C. Goodley, Cupertino, CA (US); Gregor Overney, San Jose, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 155 days.

(21) Appl. No.: 12/753,786

(22) Filed: Apr. 2, 2010

(65) Prior Publication Data

US 2010/0230589 A1 Sep. 16, 2010

Related U.S. Application Data

(62) Division of application No. 11/398,305, filed on Apr. 4, 2006, now Pat. No. 7,723,678.

(51) Int. Cl.
*H01J 49/26* (2006.01)

(52) U.S. Cl. ..... 250/288; 250/282; 250/396 R

(58) Field of Classification Search ..... 250/288
See application file for complete search history.

(56) References Cited

U.S. PATENT DOCUMENTS

| | | | | |
|---|---|---|---|---|
| 4,894,511 | A | 1/1990 | Caledonia et al. | |
| 4,968,885 | A | 11/1990 | Willoughby | |
| 5,559,326 | A | 9/1996 | Goodley et al. | |
| 6,147,347 | A | 11/2000 | Hirabayashi et al. | |
| 6,469,296 | B1 * | 10/2002 | Hansen et al. | 250/287 |
| 7,247,845 | B1 | 7/2007 | Gebhardt et al. | |
| 2005/0230635 | A1 * | 10/2005 | Takats et al. | 250/424 |
| 2006/0108539 | A1 | 5/2006 | Franzen | |

FOREIGN PATENT DOCUMENTS

DE 3840536 A1 6/1990

OTHER PUBLICATIONS

Hirabayashi, Y., et al. Direct coupling of semi-micro liquid chromatography and sonic spray ionization mass spectrometry for pesticide analysis. Rapid Communications in Mass Spectrometry. 1996, vol. 10, pp. 1891-1893.

Hirabayashi, Y., et al. Evaporation of charged fine droplets. International Journal of Mass Spectrometry and Ion Processes. 1998, vol. 175, pp. 241-245.

Hirabayashi, Y., et al. A sonic spray interface for capillary eletrophoresis/mass spectrometry. Rapid Communications in Mass Spectrometry. 1999, vol. 13, pp. 712-715.

Hirabayashi, Y., et al. Sonic spray ionization method for atmospheric pressure ionization mass spectrometry. Analytic Chemistry. 1994, vol. 66, pp. 4557-4559.

Takats, Z., et al. Mass spectrometry sampling under ambient conditions with desorption electrospray ionization. Science. 2004, vol. 306, pp. 471-473.

Takats, Z., et al. Amino acid clusters formed by sonic spray ionization. Analytical Chemistry. 2003, vol. 75, pp. 1514-1523.

* cited by examiner

*Primary Examiner* — Phillip A Johnston

(57) ABSTRACT

An apparatus and method for generating analyte ions from a sample. An ion generating device is provided having a chamber with an outlet and a surface having a material and means for applying a high velocity gas flow through the chamber toward the outlet such that charged particles are produced by physical interaction between the high velocity gas and the material. The charged particles then induce the generation of primary ions by interaction with molecules of the high velocity gas. The primary ions are emitted from the outlet of the ion generating device toward a sample-bearing surface and analyte ions are generated by impact of the primary ions on the analyte sample on the surface.

17 Claims, 6 Drawing Sheets

METHOD AND APPARATUS FOR SURFACE DESORPTION IONIZATION BY CHARGED PARTICLES

BACKGROUND INFORMATION

Mass spectrometry has benefited from numerous advances in ionization techniques over the past two decades. Among these ionization techniques, some are designed to operate on analytes presented in, or converted into gaseous form, such as atmospheric chemical ionization (APCI) and atmospheric pressure photoionization (APPI), others on analytes presented in liquid form, such as electrospray ionization (ESI), and still others on analytes presented in solid form, such as matrix-assisted laser desorption ionization (MALDI) and desorption electrospray ionization (DESI). The latter techniques may be referred to as surface ionization techniques, since they involve desorption of analytes from a surface, followed by ionization of the analytes by various charge transfer processes.

Currently, MALDI (including AP-MALDI) is the most widely used surface ionization technique. In MALDI, analyte samples are diluted in a matrix material, deposited onto a surface, and then dried, whereby the analyte sample and matrix are co-crystallized. A pulsed laser beam, usually of ultraviolet (UV) frequency, is then focused onto the sample. The energy of the laser pulse is absorbed largely by the matrix, which desorbs (evaporates) from the surface, carrying with it analyte molecules. A portion of the desorbed matrix material is also ionized by absorption of laser radiation, and a portion of the desorbed analyte molecules is, in turn, ionized by a process of charge transfer from the matrix ions.

While MALDI has proven effective in many applications, the cost of the pulsed UV laser and its less-than-unlimited durability and reliability can be significant drawbacks. Furthermore, when analytes are prepared with matrix material, ions generated from the matrix create background noise at low mass levels. Additionally, co-crystallization of the matrix and analyte tends to be non-uniform, so that crystals are not uniformly distributed throughout the sample of interest. This non-uniformity necessitates rastering of the laser across the sample in small incremental steps, generally increasing the cost and complexity of the MALDI apparatus. These disadvantages have prompted the development of alternative surface ionization techniques that do not rely on the use of a laser or matrix material to generate analyte ions from a surface.

One surface ionization technique that does not rely on either a pulse laser or matrix-based sample preparation is desorption electrospray ionization (DESI). In this technique, an electrospray process is employed to generate a stream of ions that is directed at a low angle onto a sample-bearing surface. The stream of ions that is output collides with the surface, imparting sufficient energy to desorb and ionize analytes in the sample. While the DESI technique does not suffer from the above-mentioned drawbacks of the MALDI technique, it does require high voltages to generate ions through the electrospray process. Maintaining such high voltages (or high potential differences, depending on the configuration) also increases costs and instrumental complexity.

SUMMARY OF THE INVENTION

In one aspect, the present invention provides an apparatus for generating ions that comprises a chamber including an inlet, an outlet and a surface bearing a material. The apparatus also includes means for providing a high velocity gas flow through the inlet and into the chamber such that the gas flow contacts the material on the surface of the chamber. As a result of physical interaction between the high velocity gas flow and the material, charged particles are generated that interact with the high velocity gas to produce ions within the chamber from the gas, the ions being emitted through the outlet of the chamber via the high-velocity gas flow.

In another aspect, the present invention provides an apparatus for generating analyte ions from a sample that comprises a support having a surface including an analyte sample and an ion generating device for emitting primary ions toward the sample. In one embodiment, the ion generating device includes a chamber including an outlet and a surface bearing a material, and means for applying a high velocity gas flow through the chamber toward the outlet such that charged particles are produced by physical interaction between the high velocity gas and the material. Interaction between the charged particles and the high velocity gas causes the generation of primary ions from the high velocity gas within the chamber, the primary ions then being emitted from the outlet toward the support. Analyte ions are generated by impact of the primary ions on the analyte sample.

In a further aspect, the present invention provides a method of generating a directed stream of ions that comprises forcing a gas into contact with a surface bearing a material at high velocity, the contact between the high velocity gas and the material generating charged particles that then induce generation of primary ions from the high velocity gas. The primary ions are then focused through an orifice in a selected direction.

In yet another aspect, a method of generating analyte ions from a sample is provided that comprises providing an analyte sample on a first surface, forcing a gas into contact with a second surface bearing a material at high velocity, the contact between the high velocity gas and the material generating charged particles, the charged particles interacting with the high velocity gas to generate primary ions from the high velocity gas, and emitting the primary ions toward the analyte sample on the first surface, the impact of the primary ions inducing generation of analyte ions.

The present invention also provides an apparatus for generating and detecting ions of an analyte that comprises a porous mesh including an analyte sample, the mesh having first and second sides, an ion generating device arranged on the first side of the mesh directed so as to emit primary ions at the mesh, and a collection conduit arranged adjacent to the mesh on the second side opposite from the ion generating device.

In another aspect, the present invention provides a method of generating and detecting ions of an analyte that comprises depositing a sample containing the analyte on a mesh having first and second sides, directing a stream of primary ions onto the first side of the mesh, an impact of the stream of ions on the sample within the mesh causing formation of analyte ions that emerge from the second side of the mesh, and collecting the analyte ions that emerge from the second side of the mesh.

DETAILED DESCRIPTION

A. Definitions

In describing and claiming the present invention, the following terminology will be used in accordance with the definitions set out below.

A 'material' is defined herein to be broadly inclusive of any solid or liquid substance, and can include a film, layer, droplet, particulate, crystal, element, organic compound, inorganic compound, chemical, reagent, catalyst, colloid, suspension, and any combination thereof.

A high velocity gas is defined herein to be a moving fluid comprising a first gaseous component having a velocity of greater than 50 m/s and may include other fluid components such as other gases, vapors, aerosols, or liquid streams entrained in the flow of the first gaseous component.

As used in this specification and the appended claims, the singular forms "a," "an," and "the" include plural referents unless the context clearly dictates otherwise. Thus, 'a' material can include more than one type of material, and a high velocity gas can include more than one species of gas or fluid.

The term "adjacent" means near, next to or adjoining. Something adjacent may also be in contact with another component, surround (i.e. be concentric with) the other component, be spaced from the other component or contain a portion of the other component.

The term "electrospray ionization source" refers to a nebulizer and associated parts for producing electrospray ions by an electrospray process. The nebulizer may or may not be at ground potential. The term should also be broadly construed to comprise an apparatus or device such as a tube with an electrode that can discharge charged particles that are similar or identical to those ions produced using electrospray ionization techniques well known in the art.

B. Description

Figure 1:
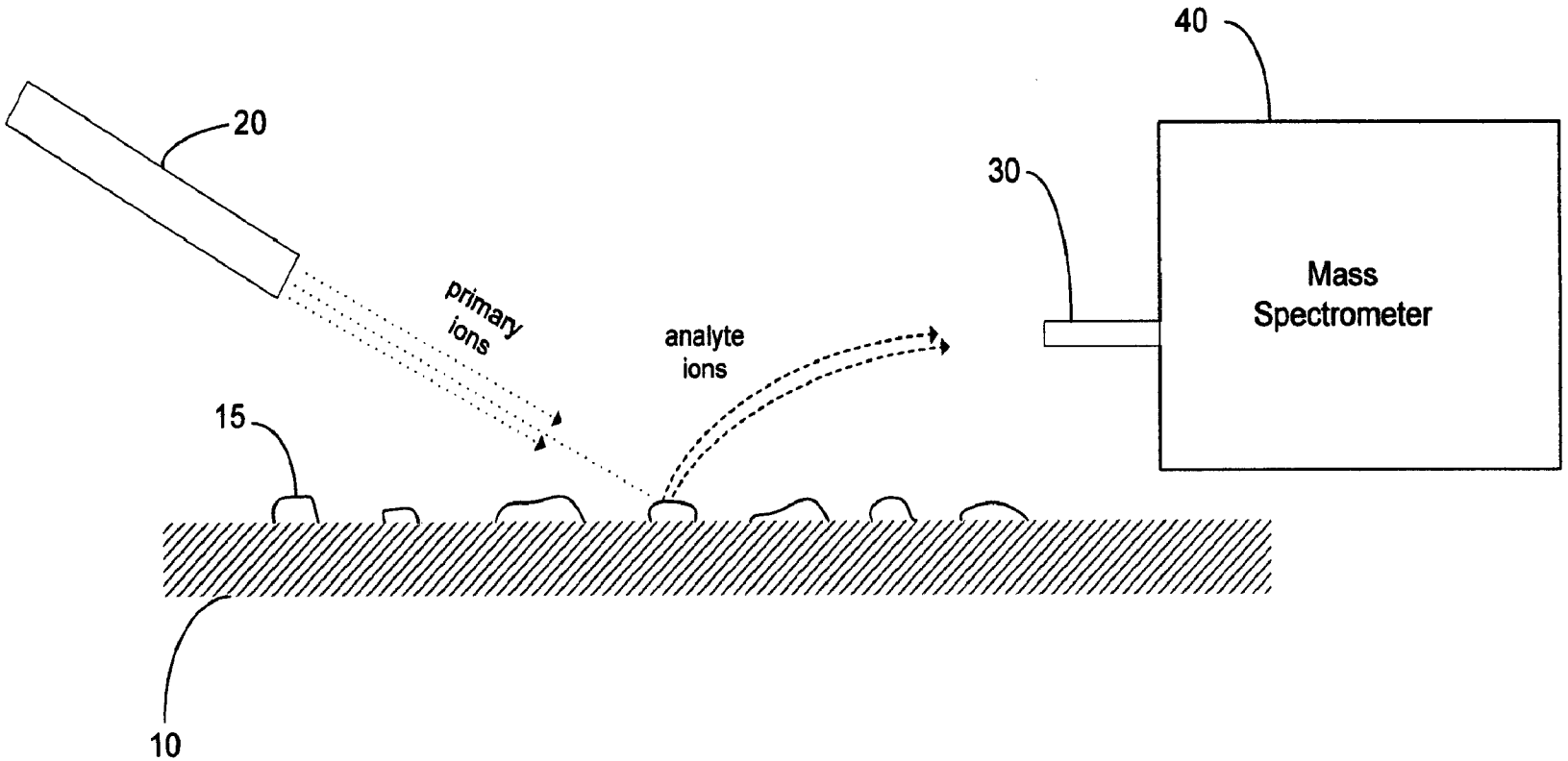
FIG. 1 is a schematic illustration of an apparatus for generating ions from a surface by impact of charged particles generated by a high-velocity gas according to an embodiment of the present invention.

FIG. 1 shows an example embodiment of an apparatus for generating analyte ions from a sample according to the present invention. As shown, the apparatus includes a support 10 including an analyte sample 15, an ion generating device 20 which directs primary ions toward the analyte sample, and a collecting conduit 35 coupled to a mass spectrometer 40.

The support 10 may comprise any sample holder known in the art and may be movable in horizontal (X and Y) directions according to electronic signals received from a controller (not shown). The analyte sample of interest 15 may comprise a single analyte or a plurality of different analytes and may be positioned in separate and distinct locations on the support 10 (as shown). In the latter case, specific analytes are generally associated with X,Y coordinates on the support 10, so that the location of the specific analytes can be readily determined. Since only a portion of the plate is exposed to the emissions of the ion generating device 20 at a given time, the support 10 can be moved to expose specific coordinates, and thus specific samples, to the emitted ions during operation. The support 10 and samples may be situated in a region maintained at atmospheric pressure, although this is not necessary.

Upon the impact of the primary ions emitted by the ion generating device onto the exposed sample, a portion of the analytes are desorbed and ionized. The desorbed analyte ions are then attracted to the collecting conduit 35 by pressure differentials as well known in the art. The analyte ions are then filtered and detected in mass spectrometer 40. The mass spectrometer may comprise any known types and configurations, including, without limitation, a multipole, time-of-flight (TOF), ion trap, orbitrap, Fourier-transform ion cyclotron resonance (FT-ICR) or any combination thereof in a tandem configuration.

Figure 2A:
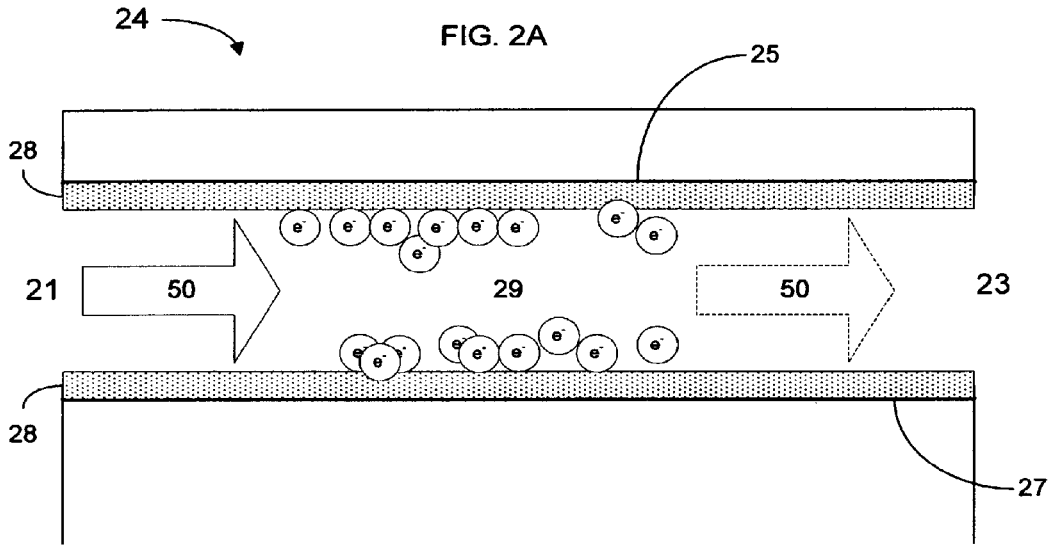
FIG. 2A shows an axial cross section of an embodiment of an ion generating device according to the present invention illustrating the stripping of electrons from a surface material.

An example configuration of the ion generating device 20 according to the present invention is described with reference to FIG. 2A. The ion generating device 20 includes a chamber 24 having an inlet 21 and an outlet 23, a first surface 25, and a second surface opposite from the first surface 27, defining a space 29 therebetween. The chamber may comprise a channel, a tube, a nozzle and in general any delimited space through which a high velocity gas 50 may flow. A material 28 is situated on one or both surfaces 25, 27 (as shown). It is noted, however, that the material can be an integral part of the surface rather than a distinct substance.

A pressurized gas source (not shown) is coupled to the inlet 21 of the chamber 24 such that a stream of high velocity gas 50 flows through the space 29 from the inlet 21 to the outlet 23 and contacts the material 28 in the chamber. The velocity of the gas 50 is set high enough, for example 60-1000 m/s, so that the gas is able to strip off electrons and possibly other charged particles off of the material 28 by frictional, triboelectric effects. As shown schematically in FIG. 2A, as the high-velocity gas passes through the chamber, electrons are stripped from the material and accumulate along the surfaces 25, 27. In a specific embodiment, the chamber may comprise an annular tube, shown in cross-section in FIG. 2C. In this embodiment, the high-velocity gas 50 flows through the tube along the axis into and out of the page in the annular space 29 between concentric surfaces 25, 27 and contacts the material 28 situated on the surfaces. The diameter of the annular tube can be on the micron or even nanometer scale in which case the gas flow is forced into an extremely narrow space 29, greatly enhancing the shearing forces brought to bear on the material.

Charge stripping can occur because positive or negative charges tend to accumulate at the outer molecular structure of the material, placing them in a position to be removed more easily from the structure when frictional forces are applied. The number of charged particles produced in this manner depends on the chemical structure of the material 28 from which the particles are drawn. Any number of materials can be used effectively in this context, but materials with a low work function, which is the amount of energy needed to strip an electron from the material, will produce greater charged particle concentrations. Generally, metals have a low work function, as do electrolytes such as water; organic polymers tend to have a somewhat higher work function (but may be particularly useful for certain applications); and dielectrics such as quartz or glass have comparatively higher work functions. It is emphasized however, than any of these materials can be used depending on the intended application. The high-velocity gas 50 may comprise a relatively inert carrier gas, such as nitrogen ($N_2$), which may be mixed with a more reactive gas or fluid, such as water vapor, air, a solvent such as methanol, etc. that is propelled by the carrier gas. The reactive gas or fluid component (or at least a portion thereof) reacts with the energetic electrons that have been stripped from the material 28, producing primary ions from gas molecules within the space 29 of the chamber 24.

For example, primary ions may be produced from water molecules when water vapor is included in the high-velocity gas. In this case, when an energetic electron is stripped by action of the high-velocity gas from the material 28 within the chamber 24, it may collide with a water molecule and strip off one of its electrons, yielding a short-lived water ion [$H_20^+$] and a free electron. The water ion and free electron quickly interact with a neutral water molecule whereby the water ion attracts a hydrogen atom in the neutral, yielding a hydronium ion [$H_3O^+$], and the remaining hydroxyl group of the water molecule immediately takes up the free electron, yielding a hydroxyl ion [$OH^-$]. While this is merely one example of how an initial electron stripping process can lead to primary ion formation, similar processes can occur with other reactive gases such as methanol vapor.

Figure 2B:
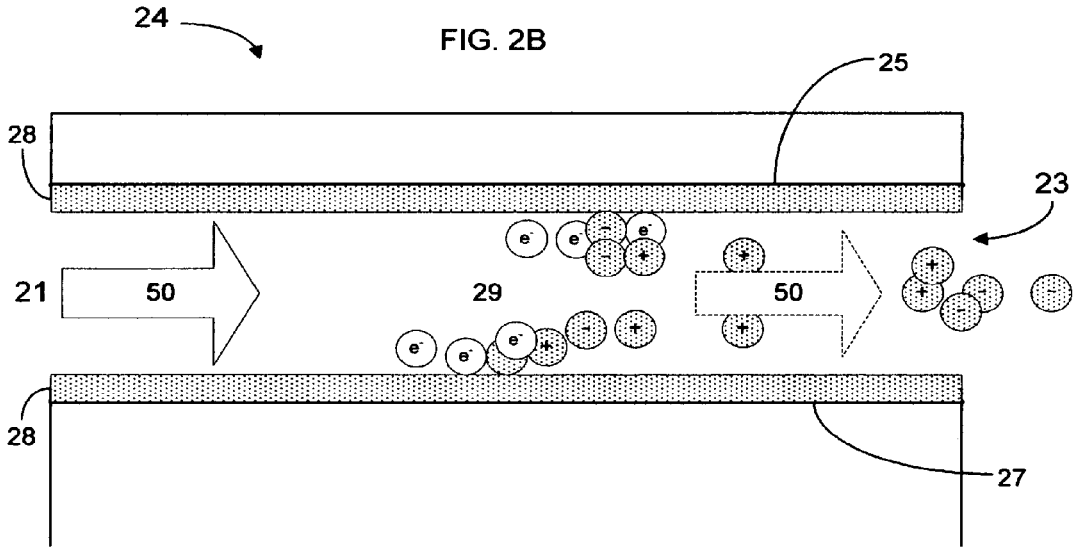
FIG. 2B shows an axial cross section of an embodiment of an ion generating device according to the present invention illustrating the generation of primary ions from the high velocity gas following the stripping of electrons.
Figure 2C:
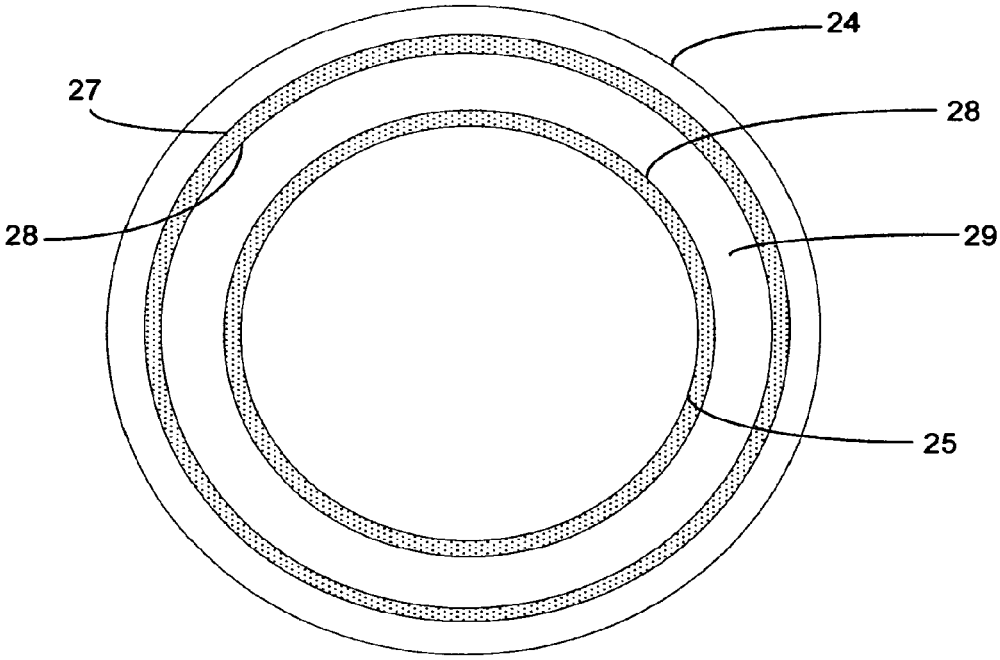
FIG. 2C is a cross-sectional view of an embodiment of the ion generating device of the present invention as an annular tube.

As shown in FIG. 2B, positive and negative primary ions (denoted by plus and minus signs, respectively) are formed near the surfaces 25, 27 by interaction of gas molecules in space 29 with the electrons stripped from the surfaces. These primary ions quickly become entrained in the high-velocity gas stream that flows through space 29. This stream is then output from the outlet 23 of the chamber 24 at high kinetic energies. The axis of the chamber 24 along which the high-velocity gas flows and ions are propelled can be oriented so that the stream of primary ions in the gas flow emerging from outlet 23 is directed toward the sample-bearing surface. For example, the chamber 24 may be oriented at a shallow angle with respect to the surface to promote desorption of analytes.

Figure 6:
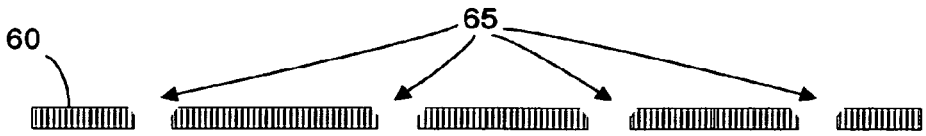
FIG. 6 shows an embodiment of a mask that may be used in the apparatus for generating from a surface as illustrated in FIG. 3.
Figure 3:
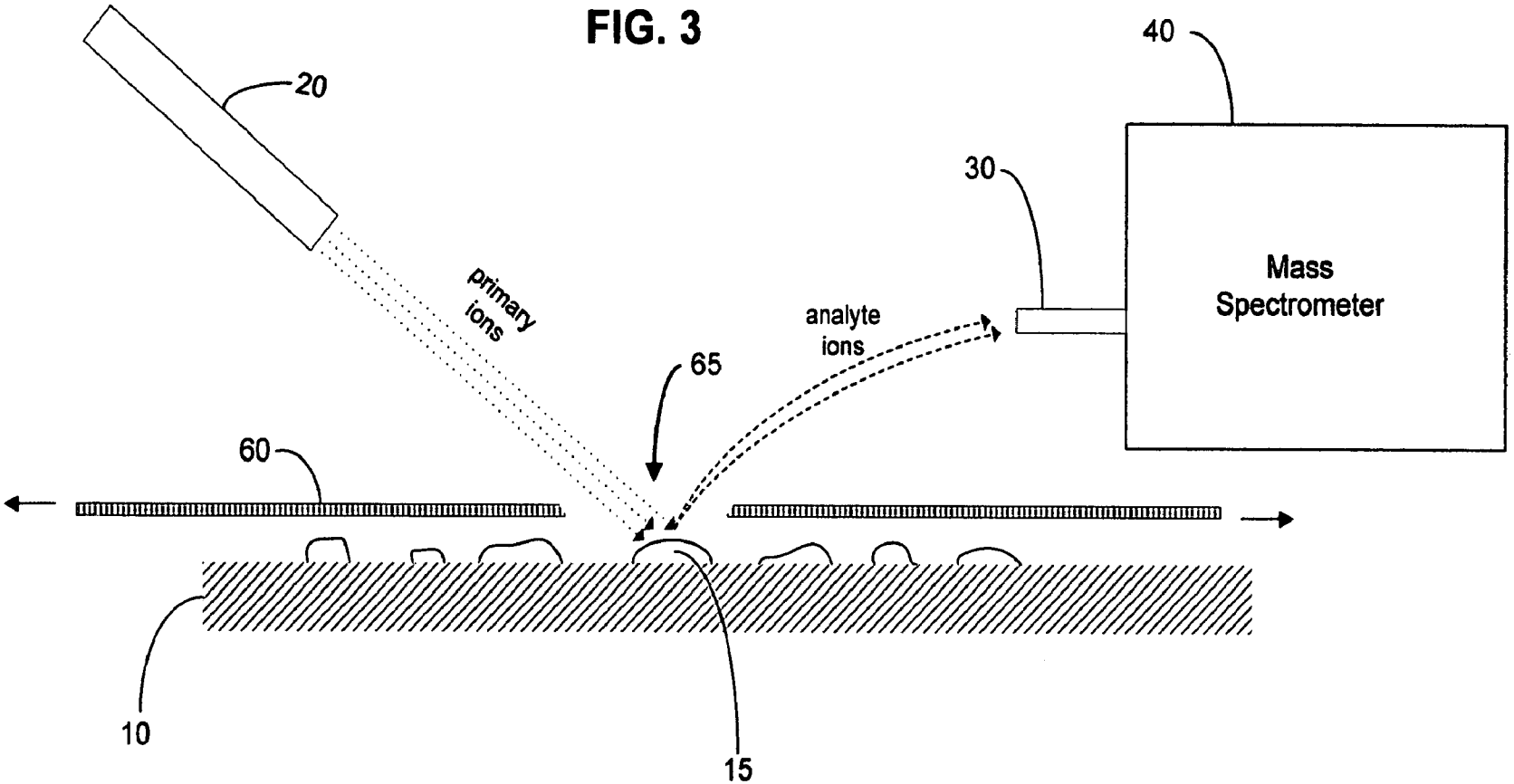
FIG. 3 shows an embodiment of an apparatus for generating ions from a surface according to the present invention in which a mask is placed over the surface.

Although the stream is directed, there is some divergence of the primary ions as they are expelled from the outlet of the chamber. Due to this divergence, the primary ions can impact a wide area on the sample support, and ionize analytes in scattered samples. Since it is desirable in many applications for only one sample to be ionized at a time, a mask may be applied to block the primary ion stream in all locations except for the area of the support bearing a single sample. An example of an apparatus according to the present invention employing a mask for this purpose is shown in FIG. 3. As shown, a mask 60 is positioned horizontally over the support 10 bearing the samples. The mask includes a through-hole 65 having dimensions on the scale of the area on the support containing a single sample. According to one embodiment, the mask 60 is movable in X, Y directions (left and right, and into and out of the page as shown), so that different analyte samples may be positioned directly under the through-hole 65 sequentially. In this case, the ion generating device 20 is controllably shifted in orientation accordingly to aim towards the through-hole 65. In alternative implementations, the mask may include a plurality of through-holes as shown in FIG. 6. The spacing of the plurality of through-holes 65 may match the spacing of analyte samples on support 10, with the beam of primary ions aimed at one through-hole at a time. The number of through-holes 65 in the mask 60 may be less then or equal to the number of analyte sample spot positions; in the latter case the mask need only be moved to follow motion of the sample support 10.

All of the primary ions emitted from the ion generating device 20 are blocked by the mask 60 except for those that are aimed at the through-hole 65, which pass unimpeded to the analyte sample 15. The through-hole 65 may have tapered edges to allow primary ions aim at a shallow angle through. Upon impact with the analyte sample, a portion of the analytes are desorbed and ionized by the impact of the primary ions. The ions that emerge from the analyte sample, termed 'secondary' or analyte ions to distinguish them from the primary ions emitted by the ion generating device, migrate to and enter the conduit 35. In this manner, the mask allows the secondary ions from one sample location at a time to pass to the mass spectrometer for analysis. A voltage may be applied at the conduit 35 to select a particular ion polarity for entry into the mass spectrometer 40. Regardless of whether such a voltage is applied, analyte ions are guided downstream into the mass spectrometer 40 by gas flows and/or pressure differentials.

Figure 4:
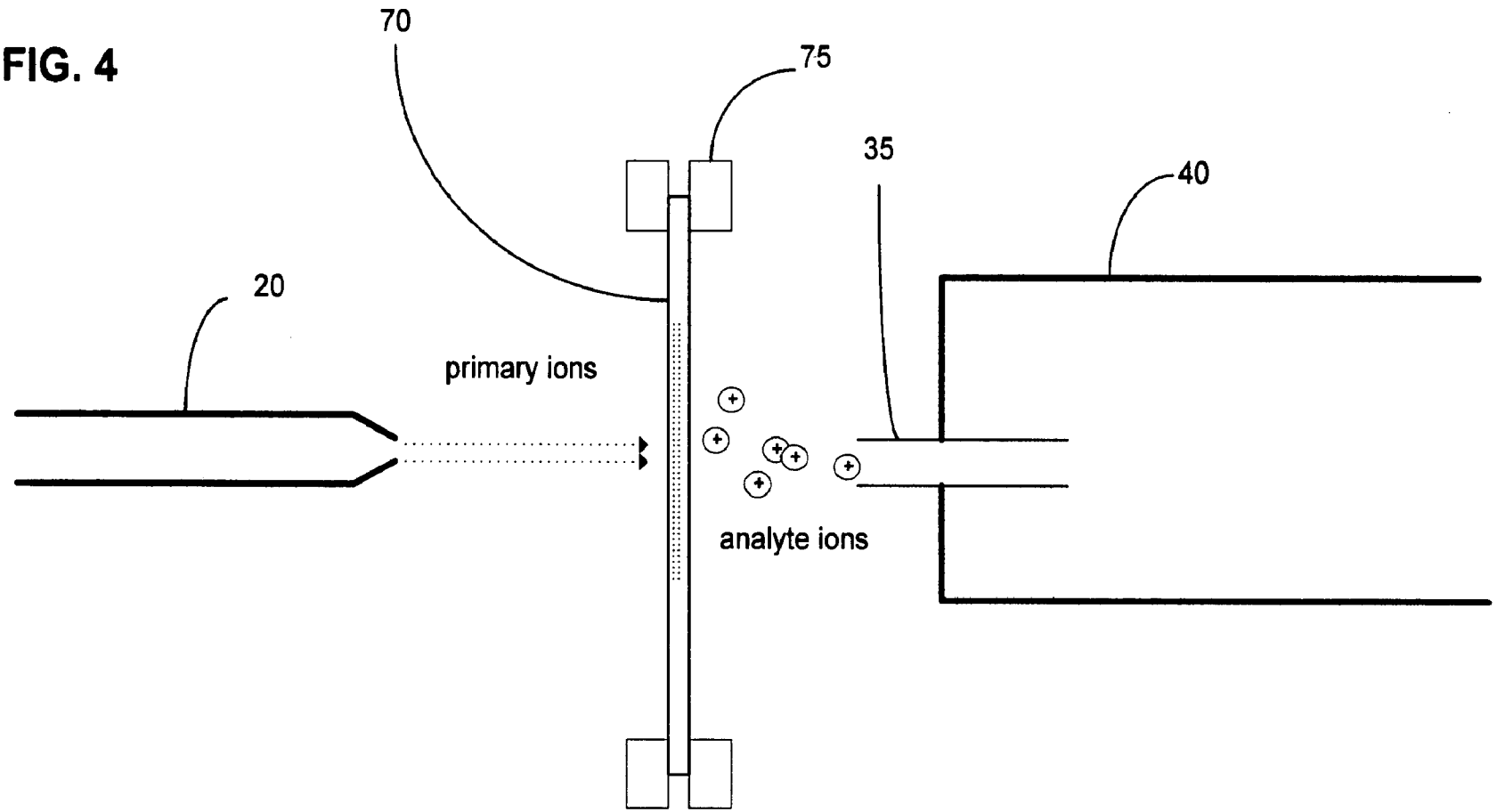
FIG. 4 shows an embodiment of an on-axis configuration according to the present invention.

FIG. 4 shows another embodiment of the present invention in which an ion generating device 20 is arranged on one side of a sample bearing porous surface, or mesh 70, and the collecting conduit 35 is arranged on the opposite side of the mesh 70. This arrangement can be termed an "on-axis" configuration. The mesh 70 may comprise, for example, filter paper, Teflon, or a thin metallic substrate with punched or etched micron-scale through-holes. It is important that the material of the mesh 70 does not react with the primary ions to create any background signals. The analyte sample is deposited on the mesh 70 and then dried and may be suspended or embedded in the through-holes. The mesh may be fitted into a supporting structure 75 to which it can be coupled in numerous ways. It can be implemented so that the mesh is pulled by a motor (not shown) through the structure in the manner of a belt, so that different portions of the mesh may be exposed to the stream from the ion generating device 20.

The ion generating device 20 is arranged to emit primary ions toward a first side of the mesh as shown. It is useful for the axis of the ion generating device 20 and stream of primary ions to be approximately perpendicular (between 75 and 105 degrees) to the first surface of the mesh 70, but this is not necessary. As the primary ions impact the analyte sample in the mesh 70, the energy of the collisions ionizes neutral analytes by a process of charge transfer and dislodges them from the through-holes. By transfer of the momentum of the primary ions, the analyte ions are propelled toward and emerge from the second side of the mesh 70, opposite from the ion generating device 20. As they emerge, the analyte ions are drawn by pressure differentials toward the conduit 35 into the mass spectrometer 40. The on-axis configuration provides high ionization efficiency and ion collection efficiency as the primary ions are precisely directed at a sample of interest rather than at an angle, and the collection conduit is positioned precisely where the analyte ions tend to emerge, on axis with the ion generating device. The on-axis configuration can also be used with other types of primary ion sources other than the ion generating device described, including an electrospray ionization source (DESI).

EXAMPLE

Figure 5:
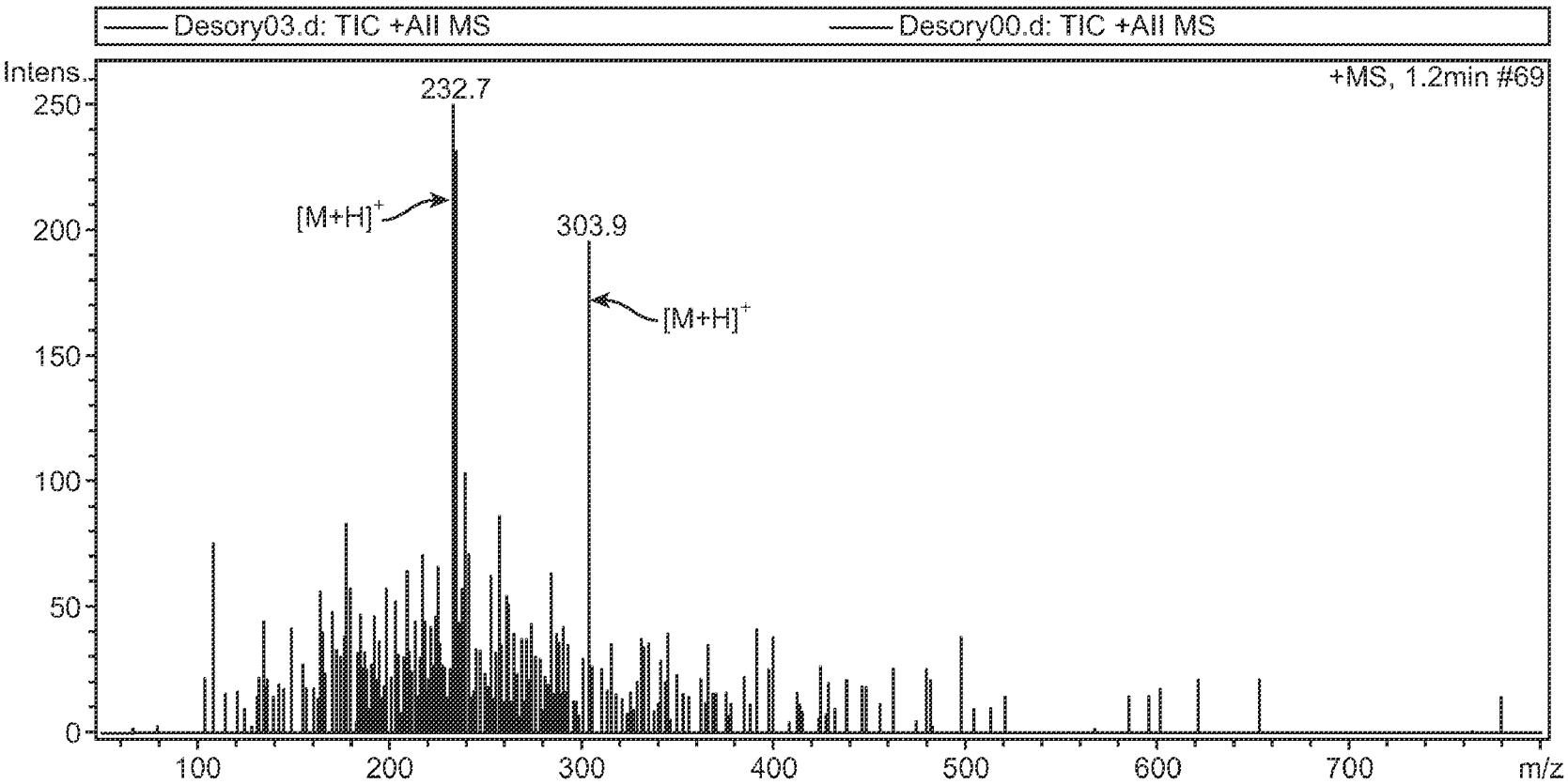
FIG. 5 shows an example mass spectrum taken using an ion generating device positioned in an on-axis configuration according to the present invention.

A mixture of two known chemicals with known mass/charge ratios of 304 and 234, respectively, were placed on filter paper positioned between two support plates having an array of openings. An ion generating device was positioned on one side of the filter paper in an on-axis configuration opposite from a collection conduit leading to a mass spectrometer. A stream of nitrogen gas was set to 4.34 liters/min and a small flow of liquid methanol (500 ml/min) was also pumped to the ion generating device, which was vaporized by the. Ions were observed as shown in the mass spectrum of FIG. 5. It is noted that the apparatus did not require any voltages to be maintained either at the ion generating device or the inlet to the mass spectrometer. A control experiment was also performed in which the filter paper was replaced with a non-permeable polymer membrane. No ions were observed in the control experiment, indicating that the ions originated from neutral molecules impacted by charged particles emitted by the ion generating device, including hydronium ions and possibly ionized methanol.

One advantageous application of the surface ionization system and method of the present invention (among other) is in analysis of tissue for DNA analysis. A current method of preparing tissue material for analysis is embedding it in formalin-fixed, paraffin tissue slides, or in deparaffin-ized pathology tissue slides. The tissues are thereby preserved and can be archived for subsequent analysis by this preparation. These slides constitute suitable analyte-bearing support surfaces which can be used in the context of surface ionization of the present invention conveniently and at low cost.

Having described the present invention with regard to specific embodiments, it is to be understood that the description is not meant to be limiting since further modifications and variations may be apparent or may suggest themselves to those skilled in the art. It is intended that the present invention cover all such modifications and variations as fall within the scope of the appended claims.

What is claimed is:

1. An apparatus for generating and detecting ions of an analyte comprising:

a porous mesh including an analyte sample, the mesh having first and second sides;

an ion generating device arranged on the first side of the mesh directed so as to emit primary ions at the mesh; and a collection conduit arranged adjacent to the mesh on the second side opposite from the ion generating device.

2. The apparatus of claim 1, wherein the ion generating device includes an electrospray ionization source.

3. The apparatus of claim 1, wherein the ion generating device includes:

i) a chamber including an outlet and a surface having a material; and ii) means for applying a high velocity gas flow through the chamber toward the outlet such that charged particles are produced by physical interaction between the high velocity gas and the material, the charged particles inducing generation of primary ions through interaction with the high velocity gas which ions are emitted from the outlet toward the porous mesh.

4. The apparatus of claim 3, wherein the high velocity gas comprises nitrogen.

5. The apparatus of claim 3, wherein the high velocity gas further comprises water vapor.

6. The apparatus of claim 3, wherein the material comprises at least one of a metal, a polymer, glass and silicon.

7. The apparatus of claim 1, wherein the ion generating device is directed perpendicular to the first side of the mesh.

8. The apparatus of claim 3, wherein the gas flow has a velocity of at least 60 m/s.

9. A method of generating and detecting ions of an analyte comprising:

depositing a sample containing the analyte on a mesh having first and second sides;

directing a stream of primary ions onto the first side of the mesh, an impact of the stream of ions on the sample within the mesh causing formation of analyte ions that emerge from the second side of the mesh; and collecting the analyte ions that emerge from the second side of the mesh.

10. The method of claim 9, wherein the directing of a stream of primary ions comprises emitting the primary ions from an ion generating device that is aimed toward the mesh.

11. The method of claim 10, wherein the primary ions emitted from the ion generating device are generated by means of electrospray ionization.

12. The method of claim 10, wherein the primary ions emitted from ion generating device are generated by physical interaction between charged particles stripped from a material situated within the ion generating device by a high velocity gas and molecules of the high velocity gas.

13. The method of claim 12, wherein the high velocity gas comprises nitrogen.

14. The method of claim 12, wherein the high velocity gas further comprises water vapor.

15. The method of claim 12, wherein the high velocity gas further comprises a solvent.

16. The method of claim 12, wherein the gas has a velocity of at least 60 m/s.

17. The apparatus of claim 12, wherein the material comprises at least one of a metal, a polymer, glass and silicon.

* * * * *

UNITED STATES PATENT AND TRADEMARK OFFICE

CERTIFICATE OF CORRECTION

PATENT NO. : 8,129,677 B2
APPLICATION NO. : 12/753786
DATED : March 6, 2012
INVENTOR(S) : Jean-Luc Truche et al.

It is certified that error appears in the above-identified patent and that said Letters Patent is hereby corrected as shown below:

On the Title page, in field (56), under "Other Publications", in column 2, line 9, delete "eletrophoresis/mass" and insert -- electrophoresis/mass --, therefor.

In column 8, line 42, in Claim 17, delete "apparatus" and insert -- method --, therefor.

Signed and Sealed this
Tenth Day of July, 2012

David J. Kappos

David J. Kappos
*Director of the United States Patent and Trademark Office*